US009835989B2

(12) United States Patent
Kitabayashi

(10) Patent No.: US 9,835,989 B2
(45) **Date of Patent: *Dec. 5, 2017**

(54) IMAGE FORMING APPARATUS

(71) Applicant: KYOCERA Document Solutions Inc., Osaka (JP)

(72) Inventor: Yuta Kitabayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/407,567

(22) Filed: Jan. 17, 2017

(65) Prior Publication Data

US 2017/0205735 A1 Jul. 20, 2017

(30) Foreign Application Priority Data

Jan. 18, 2016 (JP) ..... 2016-007081

(51) Int. Cl.
*G03G 15/16* (2006.01)

(52) U.S. Cl.
CPC ..... *G03G 15/1665* (2013.01); *G03G 15/1605* (2013.01); *G03G 15/1675* (2013.01); *G03G 2215/0132* (2013.01)

(58) Field of Classification Search
CPC ..... G03G 15/1665
See application file for complete search history.

(56) References Cited

U.S. PATENT DOCUMENTS

2009/0080924 A1* 3/2009 Kojima ..... G03G 15/0131 399/66
2012/0288292 A1* 11/2012 Kojima ..... G03G 15/0131 399/51

FOREIGN PATENT DOCUMENTS

JP H05-313522 A 11/1993
JP 2008225271 A * 9/2008

* cited by examiner

*Primary Examiner* — Victor Verbitsky
(74) *Attorney, Agent, or Firm* — Studebaker & Brackett PC

(57) ABSTRACT

An image forming apparatus 1 includes four developing devices 43, four primary transfer rollers 51, an intermediate transfer belt 54, voltage applicators 61, a current detector 62 and a voltage controller 911. The voltage applicators 61 each apply a voltage to a corresponding one of the four primary transfer rollers 51. The current detector 62 detects a first total current value JS of currents flowing through the four primary transfer rollers 51. The voltage applicators 61 apply a detection voltage VS to a primary transfer roller 51*y* among the four primary transfer rollers 51 while applying a voltage having the same polarity as the detection voltage VS to all the other primary transfer rollers 51*c*, 51*m*, and 51*k*. The detection voltage VS is applied to detect a resistance value Ry of the primary transfer roller 51*y*. The detection voltage VS has a predetermined voltage value.

10 Claims, 9 Drawing Sheets

IMAGE FORMING APPARATUS

INCORPORATION BY REFERENCE

The present application claims priority under 35 U.S.C. §119 to Japanese Patent Application No. 2016-007081, filed on Jan. 18, 2016. The contents of this application are incorporated herein by reference in their entirety.

BACKGROUND

The present disclosure relates to an image forming apparatus.

It is known that a value of a current flowing through a transfer roller in an image forming apparatus is measured.

For example, a generally known image forming apparatus determines a resistance value of a transfer roller from a value of a current detected by a detection circuit. This image forming apparatus includes the detection circuit, a constant voltage circuit and a controller. The detection circuit detects a value of a current flowing through the transfer roller. The constant voltage circuit performs constant voltage control of a voltage that is applied to the transfer roller. Further, the resistance value of the transfer roller is determined from the value of the current detected by the detection circuit when the constant voltage control is performed. The controller controls a transfer voltage based on the determined resistance value.

Through the above image forming apparatus, an appropriate transfer voltage can be applied.

SUMMARY

An image forming apparatus of the present disclosure forms an image on a recording medium. The image forming apparatus includes a specified number of developing devices, the specified number of primary transfer rollers, an intermediate transfer belt, voltage applicators, a current detector, and a voltage controller. The specified number is two or more. The specified number of developing devices each form a toner image on a corresponding one of the specified number of photosensitive drums. The specified number of primary transfer rollers are each located opposite to a corresponding one of the specified number of photosensitive drums. The intermediate transfer belt is held between the specified number of photosensitive drums and the specified number of primary transfer rollers. The voltage applicators each apply a voltage to a corresponding one of the specified number of primary transfer rollers. The current detector detects a total current value that is a sum of values of currents flowing through the specified number of primary transfer rollers. The voltage controller controls voltage values of voltages that the voltage applicators apply to the specified number of primary transfer rollers. The voltage controller causes a detection voltage to be applied to one primary transfer roller of the specified number of primary transfer rollers while causing a voltage having the same polarity as the detection voltage to be applied to all other of the primary transfer rollers. The detection voltage is a voltage that is applied to detect a resistance value of the one primary transfer roller and that has a predetermined voltage value.

BRIEF DESCRIPTION OF THE DRAWINGS

FIG. 5A is a graph showing variation of an applied voltage applied to a primary transfer roller for Y color. FIG. 5B is a graph showing variation of an applied voltage applied to a primary transfer roller for C color. FIG. 5C is a graph showing variation of an applied voltage applied to a primary transfer roller for M color. FIG. 5D is a graph showing variation of an applied voltage applied to a primary transfer roller for K color.

FIG. 9A is a graph showing variation of an applied voltage applied to the primary transfer roller for Y color. FIG. 9B is a graph showing variation of an applied voltage applied to the primary transfer roller for C color. FIG. 9C is a graph showing variation of an applied voltage applied to the primary transfer roller for M color. FIG. 9D is a graph showing variation of an applied voltage applied to the primary transfer roller for K color.

DETAILED DESCRIPTION

Figure 1:
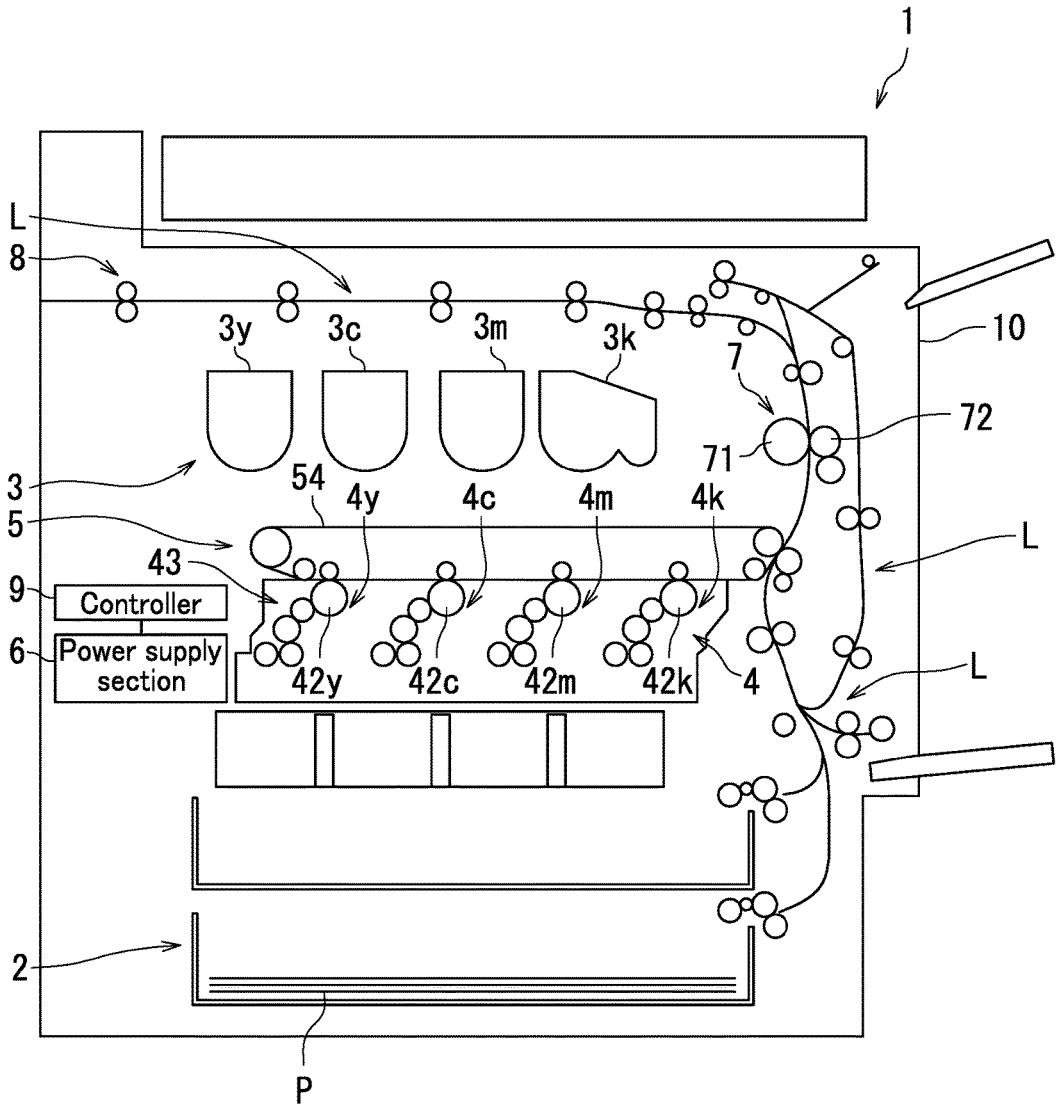
FIG. 1 is a side view illustrating a configuration of an image forming apparatus according to an embodiment of the present disclosure.

The following describes an embodiment of the present disclosure with reference to the drawings (FIGS. 1 to 9D). Elements that are the same or substantially equivalent are indicated by the same reference signs in the drawings and explanation thereof is not repeated.

First, an image forming apparatus 1 according to the present embodiment will be described with reference to FIG. 1. FIG. 1 is a diagram illustrating a configuration of the image forming apparatus 1 according to the present embodiment. The image forming apparatus 1 according to the present embodiment is a color copier.

The image forming apparatus 1 forms an image on paper P. The image forming apparatus 1 includes a housing 10, a paper feed section 2, a conveyance section L, a toner replenishment unit 3, an image forming unit 4, a transfer section 5, a power supply section 6, a fixing section 7, an ejection section 8, and a controller 9. The paper P corresponds to an example of what is referred to as "a recording medium".

The paper feed section 2 is disposed in a lower location of the housing 10 and feeds the paper P to the conveyance section L. The paper feed section 2 can accommodate a plurality of sheets of the paper P. The paper feed section 2 feeds the paper P to the conveyance section L one uppermost sheet of the paper P at a time.

The conveyance section L conveys the paper P fed by the paper feed section 2 to the ejection section 8 through the transfer section 5 and the fixing section 7.

The toner replenishment unit 3 includes four toner cartridges 3*y*, 3*c*, 3*m*, and 3*k* which are containers for supplying toners to the image forming unit 4. The toner cartridge 3*y* contains a yellow toner. The toner cartridge 3*c* contains a cyan toner. The toner cartridge 3*m* contains a magenta toner. The toner cartridge 3*k* contains a black toner.

The image forming unit 4 includes four image forming sections 4*y*, 4*c*, 4*m*, and 4*k*. The yellow toner is supplied from the toner cartridge 3*y* to the image forming section 4*y*. The cyan toner is supplied from the toner cartridge 3*c* to the image forming section 4*c*. The magenta toner is supplied from the toner cartridge 3*m* to the image forming section 4*m*. The black toner is supplied from the toner cartridge 3*k* to the image forming section 4*k*. A configuration of the image forming unit 4 will be described further below with reference to FIG. 2.

The transfer section 5 includes an intermediate transfer belt 54. The image forming unit 4 forms toner images on the intermediate transfer belt 54, and the transfer section 5 transfers the toner images onto the paper P. A configuration of the transfer section 5 will be described further below with reference to FIG. 2.

The power supply section 6 applies transfer voltages to the transfer section 5. The power supply section 6 also detects values of transfer currents flowing through the transfer section 5. A configuration of the power supply section 6 will be described further below with reference to FIG. 3.

The fixing section 7 includes a heating roller 71 and a pressure roller 72 as a pair of rollers for fixing the toner images transferred onto the paper P by the transfer section 5. The heating roller 71 and the pressure roller 72 apply heat and pressure respectively to the paper P. Through the above, the fixing section 7 fixes the unfixed toner images transferred onto the paper P by the transfer section 5. The ejection section 8 ejects the paper P having the toner images fixed thereon out of the apparatus.

The controller 9 controls operation of the image forming apparatus 1. A configuration of the controller 9 will be described further below with reference to FIG. 4.

Figure 2:
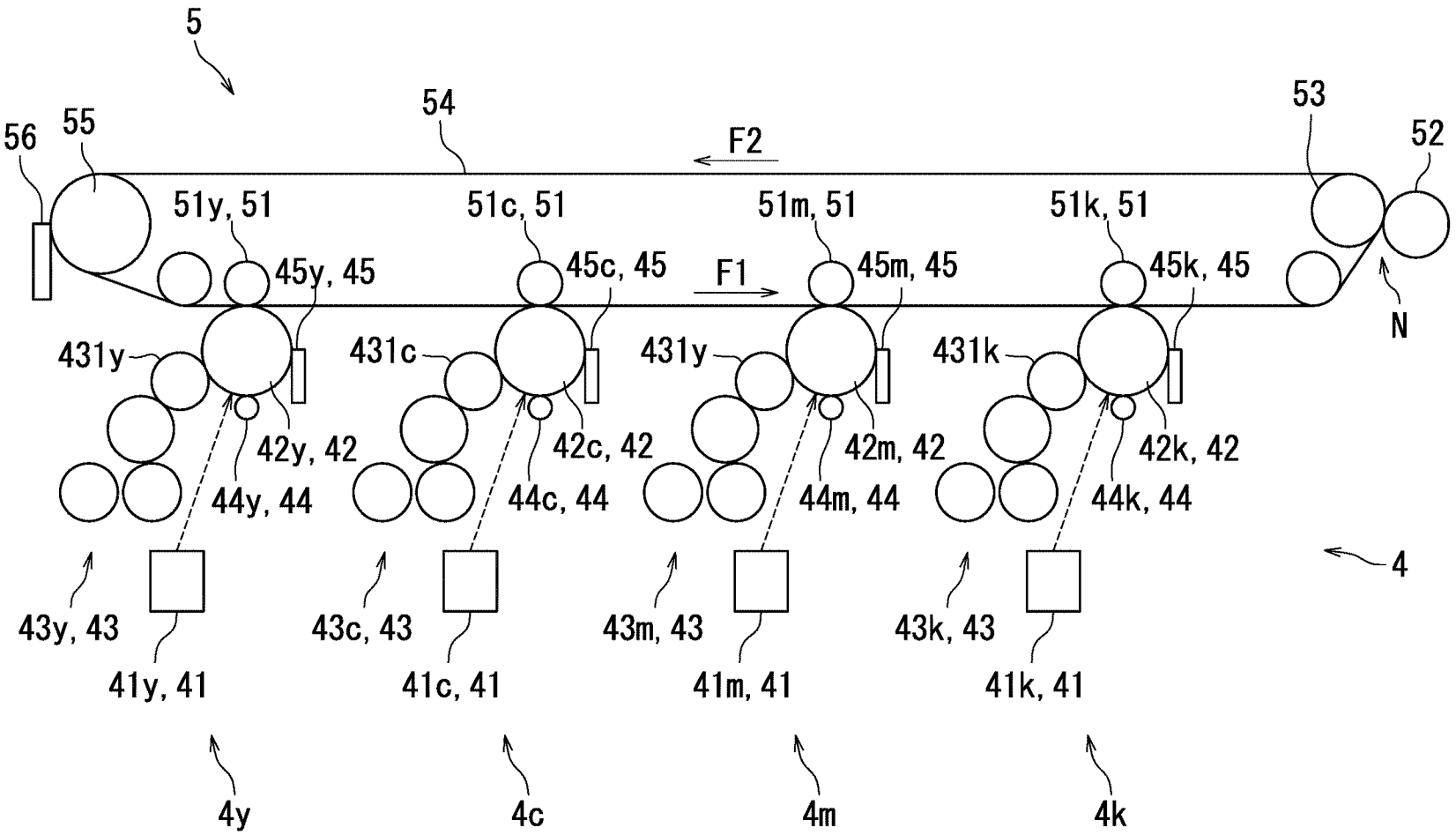
FIG. 2 is a side view illustrating configurations of an image forming unit and a transfer section illustrated in FIG. 1.

Next, the configurations of the image forming unit 4 and the transfer section 5 will be described with reference to FIG. 2. FIG. 2 is a side view illustrating the configurations of the image forming unit 4 and the transfer section 5. As illustrated in FIG. 2, the image forming unit 4 includes the four image forming sections 4*y*, 4*c*, 4*m*, and 4*k*. A "specified number" is four in the present embodiment.

The image forming sections 4*y*, 4*c*, 4*m*, and 4*k* each include a light exposure device 41, a photosensitive drum 42, a developing device 43, a charging roller 44, and a cleaning blade 45. The four image forming sections 4*y*, 4*c*, 4*m*, and 4*k* have substantially the same configuration except the colors of the toners to be supplied thereto. The present specification therefore describes the configuration of the image forming section 4*y* to which the yellow toner is supplied, and omits description of the configurations of the image forming sections other than the image forming section 4*y*, that is, image forming sections 4*c*, 4*m*, and 4*k*.

The image forming section 4*y* has a light exposure section 41*y* (41), a photosensitive drum 42*y* (42), a developing device 43*y* (43), a charging roller 44*y* (44), and a cleaning blade 45*y* (45).

The charging roller 44*y* charges the photosensitive drum 42*y* to a specific potential. The light exposure section 41*y* irradiates the photosensitive drum 42*y* with laser light to form an electrostatic latent image on the photosensitive drum 42*y*. The developing device 43*y* includes a development roller 431*y*. The development roller 431*y* supplies the yellow toner to the photosensitive drum 42*y* and develops the electrostatic latent image to form a toner image. As a result, the toner image in yellow is formed on a circumferential surface of the photosensitive drum 42*y*.

An edge of the cleaning blade 45*y* (the top edge in FIG. 2) is in sliding contact with the circumferential surface of the photosensitive drum 42*y*. The edge of the cleaning blade 45*y* in sliding contact with the circumferential surface of the photosensitive drum 42*y* removes the yellow toner remaining on the circumferential surface of the photosensitive drum 42*y*.

The transfer section 5 transfers toner images onto the paper P. The transfer section 5 includes four primary transfer rollers 51 (51*y*, 51*c*, 51*m*, and 51*k*), a secondary transfer roller 52, a drive roller 53, the intermediate transfer belt 54, a driven roller 55, and a blade 56.

The transfer section 5 transfers onto the intermediate transfer belt 54 toner images respectively formed on the photosensitive drums 42 (42*y*, 42*c*, 42*m*, and 42*k*) of the image forming sections 4*y*, 4*c*, 4*m*, and 4*k* such that the toner images are superimposed on one another. The transfer section 5 further transfers the superimposed toner images from the intermediate transfer belt 54 to the paper P.

The primary transfer roller 51*y* is disposed opposite to the photosensitive drum 42*y* with the intermediate transfer belt 54 therebetween. The primary transfer roller 51*y* can come in or out of press contact with the photosensitive drum 42*y* with the intermediate transfer belt 54 therebetween through driving by a driving mechanism, not illustrated. The primary transfer roller 51*y* is normally in press contact with the photosensitive drum 42*y* with the intermediate transfer belt 54 therebetween. Like the primary transfer roller 51*y*, the other primary transfer rollers 51*c*, 51*m*, and 51*k* are each in press contact with a corresponding one of the photosensitive drums 42 (42*c*, 42*m*, or 42*k*), with the intermediate transfer belt 54 therebetween.

The drive roller 53 is disposed opposite to the secondary transfer roller 52 and drives the intermediate transfer belt 54.

The intermediate transfer belt 54 is an endless belt that is stretched around the four primary transfer rollers 51, the drive roller 53, and the driven roller 55. The intermediate transfer belt 54 is driven by the drive roller 53 to circulate in a counterclockwise direction as indicated by arrows F1 and F2 in FIG. 2. An outer surface of the intermediate transfer belt 54 is in contact with circumferential surfaces of the respective photosensitive drums 42 (42*y*, 42*c*, 42*m*, and 42*k*). Toner images are transferred by the primary transfer rollers 51 (51*y*, 51*c*, 51*m*, and 51*k*) from the photosensitive drums 42 (42*y*, 42*c*, 42*m*, and 42*k*) to the outer surface of the intermediate transfer belt 54.

The driven roller 55 is driven to rotate by circulation of the intermediate transfer belt 54. The blade 56 is disposed opposite to the driven roller 55 with the intermediate transfer belt 54 therebetween. The blade 56 removes toners remaining on the outer surface of the intermediate transfer belt 54.

The secondary transfer roller 52 is pressed against the drive roller 53. As a result, the secondary transfer roller 52 and the drive roller 53 form a nip N therebetween. The secondary transfer roller 52 and the drive roller 53 transfer the toner images from the intermediate transfer belt 54 to the paper P while the paper P is passing through the nip N.

Figure 3:
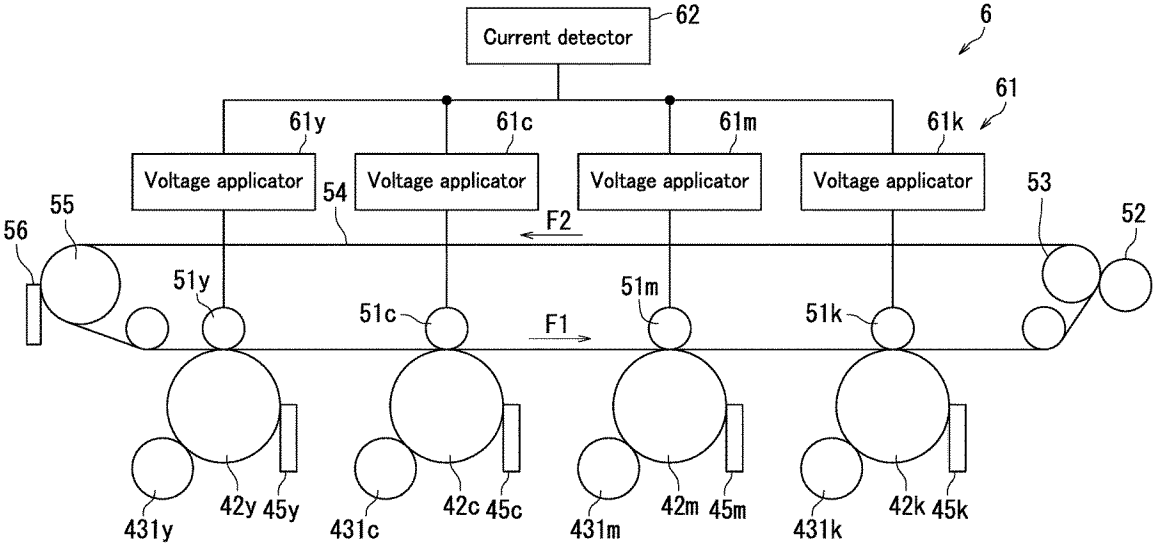
FIG. 3 is a side view illustrating a configuration of a power supply section illustrated in FIG. 1.

Next, the power supply section 6 will be described with reference to FIG. 3. FIG. 3 is a side view illustrating the configuration of the power supply section 6. The power supply section 6 includes voltage applicators 61 and a current detector 62. The voltage applicators 61 apply voltages to the primary transfer rollers 51.

The voltage applicators 61 include four voltage applicators 61*y*, 61*c*, 61*m*, and 61*k*. The four voltage applicators 61*y*, 61*c*, 61*m*, and 61*k* apply voltages to the primary transfer rollers 51*y*, 51*c*, 51*m*, and 51*k*, respectively. For example, the voltage applicator 61*y* applies to the primary transfer roller 51*y* a voltage of opposite polarity (a negative voltage in the present embodiment) to charging polarity of the toner. The photosensitive drums 42 (42*y*, 42*c*, 42*m*, and 42*k*) are grounded. As a result, the voltage applicator 61*y* applies a voltage between the primary transfer roller 51*y* and the photosensitive drum 42*y*.

The current detector 62 detects a total current value JS that is a sum of values of currents flowing through the respective four primary transfer rollers 51*y*, 51*c*, 51*m*, and 51*k*.

Figure 4:
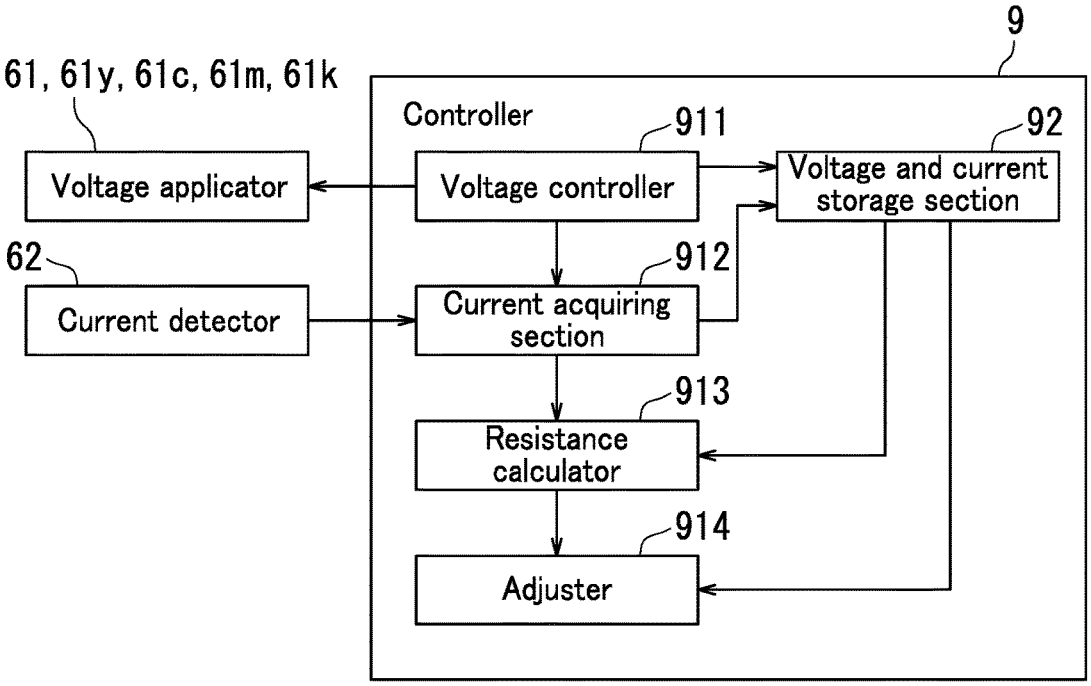
FIG. 4 is a diagram illustrating a configuration of a controller illustrated in FIG. 1.

Next, the configuration of the controller 9 will be described with reference to FIG. 4. FIG. 4 is a diagram illustrating the configuration of the controller 9. The controller 9 includes a central processing unit (CPU) and a memory. A control program is stored in the memory. The CPU implements various functional sections through execution of the control program. Also, the CPU causes the memory to implement various functional sections through execution of the control program. As a result, the various functional sections implemented by the controller 9 control operation of the image forming apparatus 1. The controller 9 includes a voltage controller 911, a current acquiring section 912, a resistance calculator 913, an adjuster 914, and a voltage and current storage section 92.

The voltage and current storage section 92 stores therein voltage values VT of voltages that the voltage applicators 61 apply to the primary transfer rollers 51 in association with total current values JS detected by the current detector 62. The voltage values VT of the voltages and the total current values JS stored in the voltage and current storage section 92 are read by the resistance calculator 913 and the adjuster 914.

The voltage controller 911 controls the voltages that the voltage applicators 61 apply to the primary transfer rollers 51*y*, 51*c*, 51*m*, and 51*k*. More specifically, the voltage controller 911 causes a detection voltage VS to be applied to one primary transfer roller 51 of the four primary transfer rollers 51 while causing a first voltage VL1 having the same polarity as the detection voltage VS to be applied to all the other primary transfer rollers 51. The one primary transfer roller 51 is for example the primary transfer roller 51*y*, and all the other primary transfer rollers 51 are for example the primary transfer rollers 51*c*, 51*m*, and 51*k*. The detection voltage VS is a voltage that is applied to detect a resistance value R between the one primary transfer roller 51 and a corresponding one of the photosensitive drums 42. The detection voltage VS has a predetermined voltage value (for example, 1000 V). The first voltage VL1 has a voltage value of at least one-200th and no greater than one-tenth (for example, 100 V) of the voltage value of the detection voltage VS.

The voltage controller 911 also causes a second voltage VL2 to be applied to all the four primary transfer rollers 51*y*, 51*c*, 51*m*, and 51*k*. A specific method for controlling voltages by the voltage controller 911 will be described further below with reference to FIG. 5.

The voltage controller 911 also causes the detection voltage VS that is varied to have different voltage values to be applied to one primary transfer roller 51 (for example, the primary transfer roller 51*y*) while causing the first voltage VL1 to be applied to all the other primary transfer rollers (for example, the primary transfer rollers 51*c*, 51*m*, and 51*k*). A relationship between the voltage values of the detection voltage VS and the total current values JS will be described further below with reference to FIG. 6.

The current acquiring section 912 acquires the total current values JS detected by the current detector 62. The current acquiring section 912 also stores to the voltage and current storage section 92 the total current values JS in association with voltage values VT of voltages that the voltage applicators 61 apply to the four primary transfer rollers 51*y*, 51*c*, 51*m*, and 51*k*.

The resistance calculator 913 determines a resistance value R of each of the primary transfer rollers 51. Specifically, the resistance calculator 913 determines the resistance value R of each of the primary transfer rollers 51 by dividing the voltage value of the detection voltage VS by the total current value JS. More specifically, the voltage controller 911 initially causes the detection voltage VS to be applied to the primary transfer roller 51*y* and the first voltage VL1 to be applied to the other three primary transfer rollers 51*c*, 51*m*, and 51*k*. During the voltage application, the current acquiring section 912 acquires a first total current value JSy. The resistance calculator 913 determines a value of resistance Ry between the primary transfer roller 51*y* and the photosensitive drum 42*y* by dividing the voltage value of the detection voltage VS by the first total current value JSy.

Next, the voltage controller 911 causes the detection voltage VS to be applied to the primary transfer roller 51*c* and the first voltage VL1 to be applied to the other three primary transfer rollers 51*y*, 51*m*, and 51*k*. During the voltage application, the current acquiring section 912 acquires a first total current value JSc. The resistance calculator 913 determines a value of resistance Rc between the primary transfer roller 51*c* and the photosensitive drum 42*c* by dividing the voltage value of the detection voltage VS by the first total current value JSc.

Then, the voltage controller 911 causes the detection voltage VS to be applied to the primary transfer roller 51*m* and the first voltage VL1 to be applied to the other three primary transfer rollers 51*y*, 51*c*, and 51*k*. During the voltage application, the current acquiring section 912 acquires a first total current value JSm. The resistance calculator 913 determines a value of resistance Rm between the primary transfer roller 51*m* and the photosensitive drum 42*m* by dividing the voltage value of the detection voltage VS by the first total current value JSm.

Finally, the voltage controller 911 causes the detection voltage VS to be applied to the primary transfer roller 51*k* and the first voltage VL1 to be applied to the other three primary transfer rollers 51*y*, 51*c*, and 51*m*. During the voltage application, the current acquiring section 912 acquires a first total current value JSk. The resistance calculator 913 determines a value of resistance Rk between the primary transfer roller 51*k* and the photosensitive drum 42*k* by dividing the voltage value of the detection voltage VS by the first total current value JSk. In the description given below, the values of resistance Ry, Rc, Rm, and Rk may be respectively referred to as the resistance value Ry of the primary transfer roller 51*y*, the resistance value Rc of the primary transfer roller 51*c*, the resistance value Rm of the primary transfer roller 51*m*, and the resistance value Rk of the primary transfer roller 51*k* for convenience. As described above, the resistance calculator 913 determines the resistance values Ry, Rc, Rm, and Rk of the respective four primary transfer rollers 51*y*, 51*c*, 51*m*, and 51*k*.

The adjuster 914 adjusts the resistance values R (Ry, Rc, Rm, and Rk). Specifically, the adjuster 914 adjusts the resistance values R based on a second total current value JSL obtained when the voltage controller 911 causes the second voltage VL2 to be applied to all the four primary transfer rollers 51*y*, 51*c*, 51*m*, and 51*k*. More specifically, the resistance values R (Ry, Rc, Rm, and Rk) are adjusted using Formulas (1) to (4) given below.

$$\text{Resistance value } Ry = (\text{voltage value of detection voltage } VS)/\{(\text{first total current value } JSy) - (\text{second total current value } JSL) \times 3/4\} \quad (1)$$

$$\text{Resistance value } Rc = (\text{voltage value of detection voltage } VS)/\{(\text{first total current value } JSc) - (\text{second total current value } JSL) \times 3/4\} \quad (2)$$

$$\text{Resistance value } Rm = (\text{voltage value of detection voltage } VS)/\{(\text{first total current value } JSm) - (\text{second total current value } JSL) \times 3/4\} \quad (3)$$

$$\text{Resistance value } Rk = (\text{voltage value of detection voltage } VS)/\{(\text{first total current value } JSk) - (\text{second total current value } JSL) \times 3/4\} \quad (4)$$

That is, for example the first total current value JSy is a sum of values of currents flowing through the four primary transfer rollers 51*y*, 51*c*, 51*m*, and 51*k* when the detection voltage VS is applied to the primary transfer roller 51*y* and the first voltage VL1 is applied to the other three primary transfer rollers 51*c*, 51*m*, and 51*k*. Accordingly, the first total current value JSy includes a sum of values of currents flowing through the primary transfer rollers 51*c*, 51*m*, and 51*k* through application of the first voltage VL1 thereto in addition to a value of a current flowing through the primary transfer roller 51*y*. Therefore, the sum of the values of the currents flowing through the primary transfer rollers 51*c*, 51*m*, and 51*k* is obtained as "(second total current value JSL)×3/4". Then, the value of the current flowing through the primary transfer roller 51*y* is determined by subtracting "(second total current value JSL)×3/4" from the first total current value JSy. The adjuster 914 divides the voltage value of the detection voltage VS by the current value determined as above to adjust the resistance value Ry determined by the resistance calculator 913.

Figure 5A:
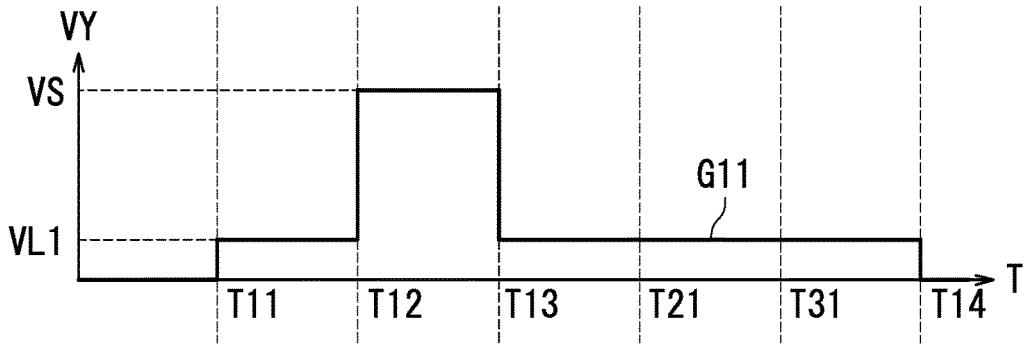
FIGS. 5A to 5D are graphs showing an example of operation of a voltage controller when the voltage value of a second voltage VL2 is the same as the voltage value of a first voltage VL1.
Figure 5B:
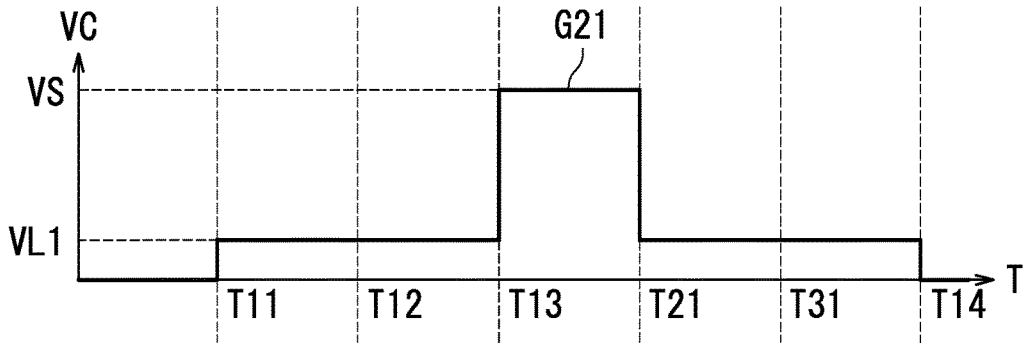
Figure 5C:
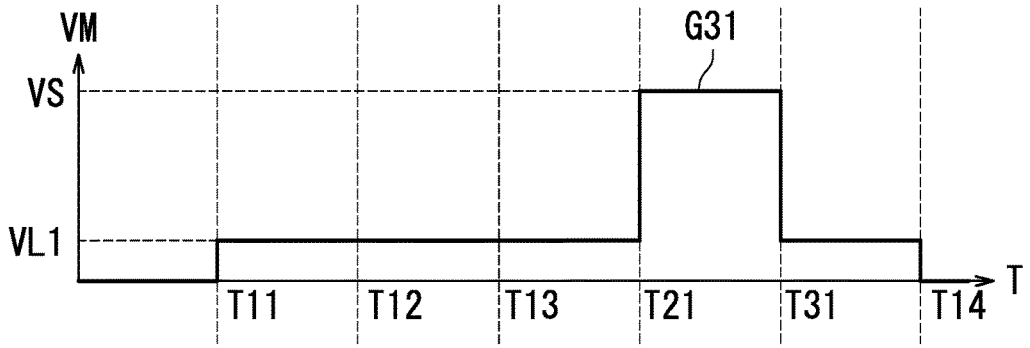
Figure 5D:
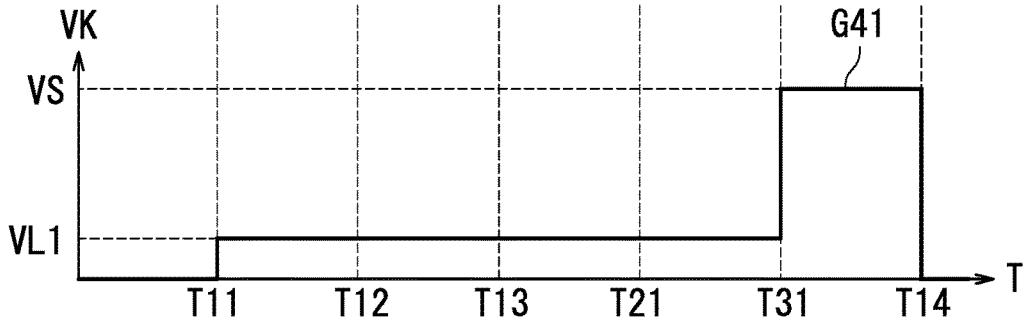

The following describes an example of operation of the voltage controller 911 with reference to FIGS. 5A to 5D. FIGS. 5A to 5D are graphs showing an example of operation of the voltage controller 911 when the voltage value of the second voltage VL2 is the same as the voltage value of the first voltage VL1. In explanation of FIGS. 5A to 5D, the voltage value of the detection voltage VS may be referred to as the detection voltage VS and the voltage value of the first voltage VL1 may be referred to as the first voltage VL1 for convenience. FIG. 5A is a graph G11 showing variation of a voltage VY applied to the primary transfer roller 51*y* for a Y (yellow) color. FIG. 5B is a graph G21 showing variation of a voltage VC applied to the primary transfer roller 51*c* for a C (cyan) color. FIG. 5C is a graph G31 showing variation of a voltage VM applied to the primary transfer roller 51*m* for a M (magenta) color. FIG. 5D is a graph G41 showing variation of a voltage VK applied to the primary transfer roller 51*k* for a K (black) color. The horizontal axis in each of the graphs represents time T and the vertical axis represents the voltage VY, VC, VM, or VK. The direction of the arrow on the vertical axis in each of the graphs indicates that the voltages VY, VC, VM, and VK are negative. In explanation of FIGS. 5A to 5D, the first voltage VL1 is for example 100 V.

First, variation of the voltage VY will be described with reference to FIG. 5A. At time point T11, the voltage controller 911 causes the first voltage VL1 to be applied to the primary transfer roller 51*y*. Then at time point T12, the voltage controller 911 changes the voltage VY applied to the primary transfer roller 51*y* from the first voltage VL1 to the detection voltage VS. Next at time point T13, the voltage controller 911 changes the voltage VY applied to the primary transfer roller 51*y* from the detection voltage VS to the first voltage VL1. Further at time point T14, the voltage controller 911 changes the voltage VY applied to the primary transfer roller 51*y* from the first voltage VL1 to zero.

Next, variation of the voltage VC will be described with reference to FIG. 5B. At time point T11, the voltage controller 911 causes the first voltage VL1 to be applied to the primary transfer roller 51*c*. Then at time point T13, the voltage controller 911 changes the voltage VC applied to the primary transfer roller 51*c* from the first voltage VL1 to the detection voltage VS. Next at time point T21, the voltage controller 911 changes the voltage VC applied to the primary transfer roller 51*c* from the detection voltage VS to the first voltage VL1. Further at time point T14, the voltage controller 911 changes the voltage VC applied to the primary transfer roller 51*c* from the first voltage VL1 to zero.

Next, variation of the voltage VM will be described with reference to FIG. 5C. At time point T11, the voltage controller 911 causes the first voltage VL1 to be applied to the primary transfer roller 51*m*. Then at time point T21, the voltage controller 911 changes the voltage VM applied to the primary transfer roller 51*m* from the first voltage VL1 to the detection voltage VS. Next at time point T31, the voltage controller 911 changes the voltage VM applied to the primary transfer roller 51*m* from the detection voltage VS to the first voltage VL1. Further at time point T14, the voltage controller 911 changes the voltage VM applied to the primary transfer roller 51*m* from the first voltage VL1 to zero.

Next, variation of the voltage VK will be described with reference to FIG. 5D. At time point T11, the voltage controller 911 causes the first voltage VL1 to be applied to the primary transfer roller 51*k*. Then at time point T31, the voltage controller 911 changes the voltage VK applied to the primary transfer roller 51*k* from the first voltage VL1 to the detection voltage VS. Next at time point T14, the voltage controller 911 changes the voltage VK applied to the primary transfer roller 51*k* from the detection voltage VS to zero.

As described above with reference to FIGS. 5A to 5D, during the period between time points T11 and T12, the voltage controller 911 causes the first voltage VL1 to be applied to all the four primary transfer rollers 51*y*, 51*c*, 51*m*, and 51*k*. A second total current value JSL that the current acquiring section 912 acquires during the above period is used by the adjuster 914 to adjust the resistance values R.

During the period between time points T12 and T13, the voltage controller 911 causes the detection voltage VS to be applied to the primary transfer roller 51*y* and the first voltage VL1 to be applied to the other three primary transfer rollers 51*c*, 51*m*, and 51*k*. A first total current value JSy that the current acquiring section 912 acquires during the above period is used by the resistance calculator 913 to determine the resistance value Ry of the primary transfer roller 51*y*.

During the period between time points T13 and T21, the voltage controller 911 causes the detection voltage VS to be applied to the primary transfer roller 51*c* and the first voltage VL1 to be applied to the other three primary transfer rollers 51*y*, 51*m*, and 51*k*. A first total current value JSc that the current acquiring section 912 acquires during the above period is used by the resistance calculator 913 to determine the resistance value Rc of the primary transfer roller 51*c*.

During the period between time points T21 and T31, the voltage controller 911 causes the detection voltage VS to be applied to the primary transfer roller 51*m* and the first voltage VL1 to be applied to the other three primary transfer rollers 51*y*, 51*c*, and 51*k*. A first total current value JSm that the current acquiring section 912 acquires during the above period is used by the resistance calculator 913 to determine the resistance value Rm of the primary transfer roller 51*m*.

During the period between time points T31 and T14, the voltage controller 911 causes the detection voltage VS to be applied to the primary transfer roller 51*k* and the first voltage VL1 to be applied to the other three primary transfer rollers 51*y*, 51*c*, and 51*m*. A first total current value JSk that the current acquiring section 912 acquires during the above period is used by the resistance calculator 913 to determine the resistance value Rk of the primary transfer roller 51*k*.

Figure 6:
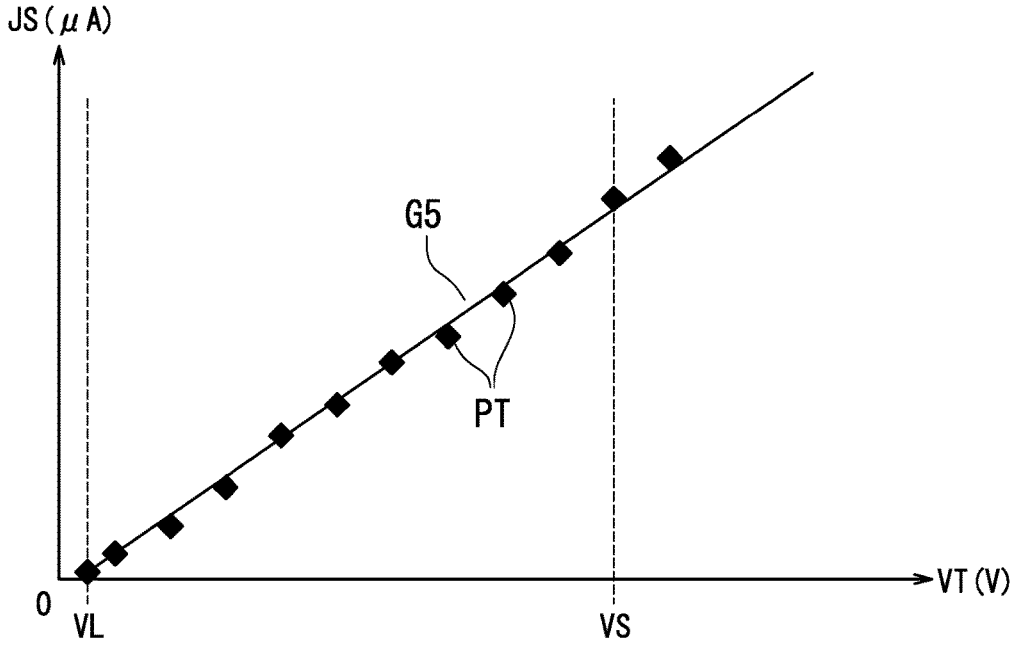
FIG. 6 is a graph showing a relationship between voltage values of a voltage applied by a voltage applicator illustrated in FIG. 3 and current values detected by a current detector.

Next, the following describes operation of the controller 9 with reference to FIG. 6. FIG. 6 is a graph G5 showing a relationship between voltage values VT of the detection voltage VS applied by one of the voltage applicators 61 and first total current values JS detected by the current detector 62. In the graph G5, the horizontal axis represents the voltage values VT and the vertical axis represents the first total current values JS. Square marks indicate measurement points PT. The resistance calculator 913 may determine the resistance value R (Ry, Rc, Rm, or Rk) of each of the primary transfer rollers 51 based on the slope of the straight line in the graph G5.

Specifically, the voltage controller 911 initially selects a plurality of (for example, 12) voltage values VT1 to VT12 from a predetermined range (for example, from 50 V to 1050 V). Then, the voltage controller 911 controls the detection voltage VS explained above with reference to FIGS. 5A to 5D to the voltage values VT1 to VT12. The current acquiring section 912 acquires the first total current values JS respectively corresponding to the voltage values VT1 to VT12 from the current detector 62. The resistance calculator 913 then determines a straight line from coordinates of the 12 measurement points in accordance with the least square method, for example. The resistance calculator 913 determines the resistance value R of each of the primary transfer rollers 51 by determining the inverse of the slope of the straight line.

When the resistance calculator 913 determines the resistance value R of each of the primary transfer rollers 51 according to the procedure explained above with reference to FIG. 6, the adjuster 914 need not adjust the resistance value R determined by the resistance calculator 913. This is because the resistance value R is determined using Formula (5) given below based on the slope of the straight line that represents an amount of change ΔJS of the first total current value JS relative to an amount of change ΔVT of the voltage value VT of the detection voltage VS as illustrated in FIG. 6.

$$\text{Resistance value } R = (\text{amount of change } \Delta VT \text{ of voltage value } VT)/(\text{amount of change } \Delta JS \text{ of first total current value } JS) \quad (5)$$

Figure 7:
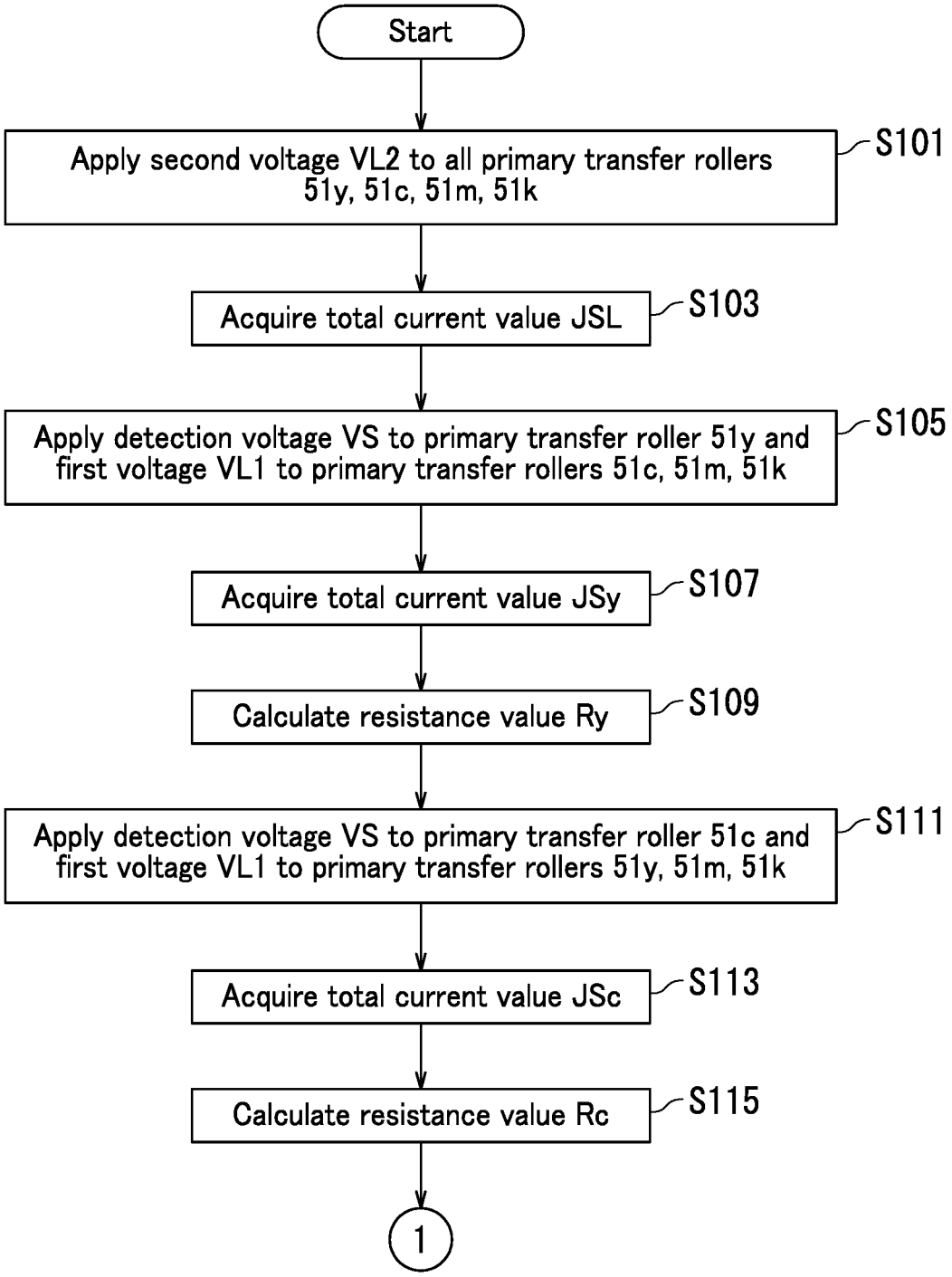
FIG. 7 is a flowchart illustrating operation of the controller illustrated in FIG. 4.
Figure 8:
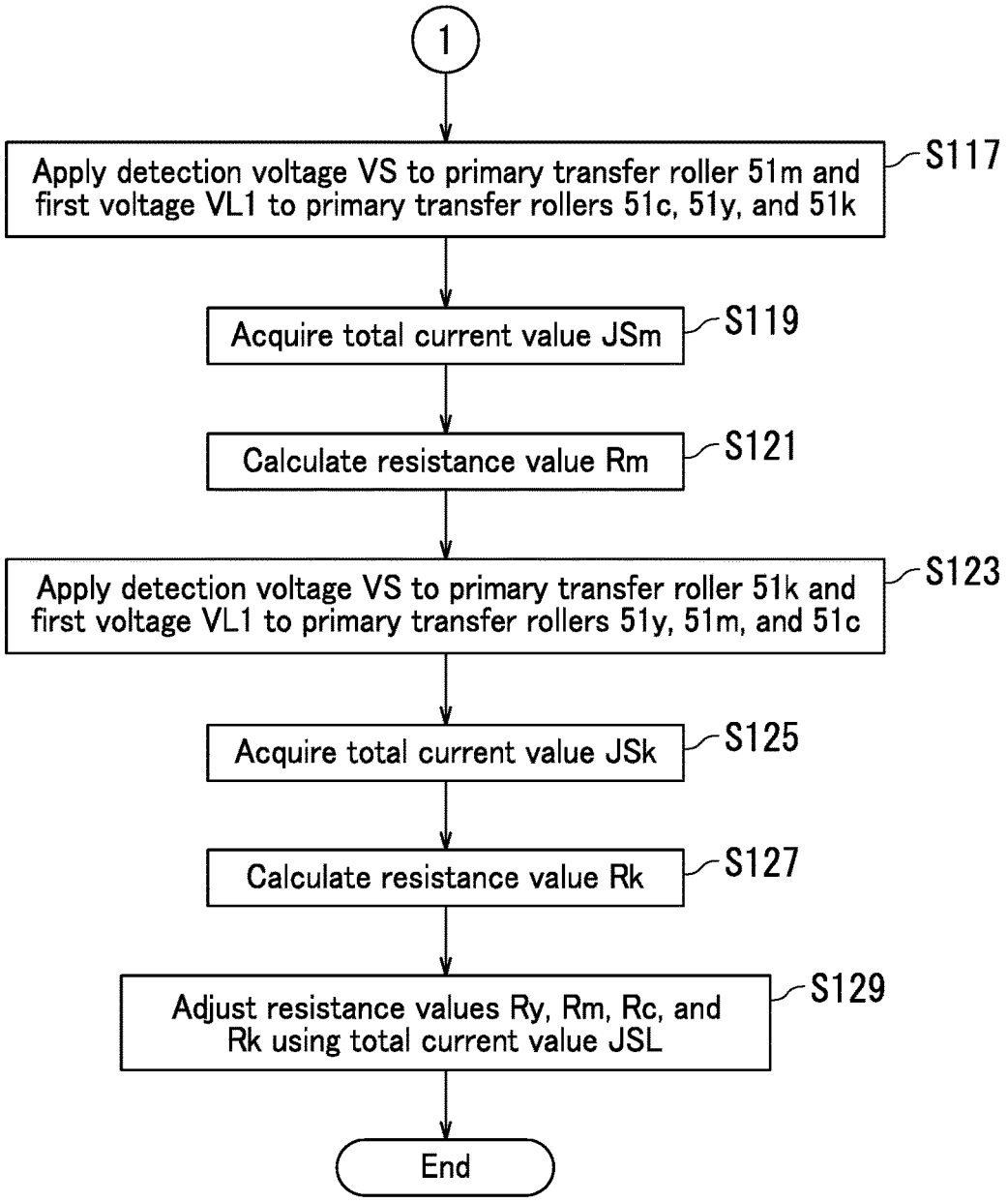
FIG. 8 is a flowchart illustrating the operation of the controller illustrated in FIG. 4.

The following describes operation of the controller 9 with reference to FIGS. 5A to 5D, 7, and 8. FIGS. 7 and 8 are flowcharts illustrating the operation of the controller 9. First, as illustrated between time points T11 and T12 in FIGS. 5A to 5D, the voltage controller 911 causes the second voltage VL2 to be applied to all the four primary transfer rollers 51*y*, 51*c*, 51*m*, and 51*k* (step S101). Then, the current acquiring section 912 acquires the second total current value JSL from the current detector 62 (step S103).

Next, as illustrated between time points T12 and T13 in FIGS. 5A to 5D, the voltage controller 911 causes the detection voltage VS to be applied to the primary transfer roller 51*y* and the first voltage VL1 to be applied to the other three primary transfer rollers 51*c*, 51*m*, and 51*k* (step S105). Then, the current acquiring section 912 acquires the first total current value JSy from the current detector 62 (step S107). Next, the resistance calculator 913 determines the resistance value Ry of the primary transfer roller 51*y* by dividing the detection voltage VS by the first total current value JSy (step S109).

Next, as illustrated between time points T13 and T21 in FIGS. 5A to 5D, the voltage controller 911 causes the detection voltage VS to be applied to the primary transfer roller 51*c* and the first voltage VL1 to be applied to the other three primary transfer rollers 51*y*, 51*m*, and 51*k* (step S111). Then, the current acquiring section 912 acquires the first total current value JSc from the current detector 62 (step S113). Next, the resistance calculator 913 determines the resistance value Rc of the primary transfer roller 51*c* by dividing the detection voltage VS by the first total current value JSc (step S115).

Next, as illustrated between time points T21 and T31 in FIGS. 5A to 5D, the voltage controller 911 causes the detection voltage VS to be applied to the primary transfer roller 51*m* and the first voltage VL1 to be applied to the other three primary transfer rollers 51*y*, 51*c*, and 51*k* (step S117 in FIG. 8). Then, the current acquiring section 912 acquires the first total current value JSm from the current detector 62 (step S119). Next, the resistance calculator 913 determines the resistance value Rm of the primary transfer roller 51*m* by dividing the detection voltage VS by the first total current value JSm (step S121).

Next, as illustrated between time points T31 and T14 in FIGS. 5A to 5D, the voltage controller 911 causes the detection voltage VS to be applied to the primary transfer roller 51*k* and the first voltage VL1 to be applied to the other three primary transfer rollers 51*y*, 51*c*, and 51*m* (step S123). Then, the current acquiring section 912 acquires the first total current value JSk from the current detector 62 (step S125). Next, the resistance calculator 913 determines the resistance value Rk of the primary transfer roller 51*k* by dividing the detection voltage VS by the first total current value JSk (step S127).

Then, the adjuster 914 adjusts the resistance values Ry, Rc, Rm, and Rk using the second total current value JSL acquired in step S103 (step S129), whereby the processing ends. More specifically, the adjuster 914 adjusts the resistance values Ry, Rc, Rm, and Rk using Formulas (1) to (4) explained above with reference to FIG. 4.

Figure 9A:
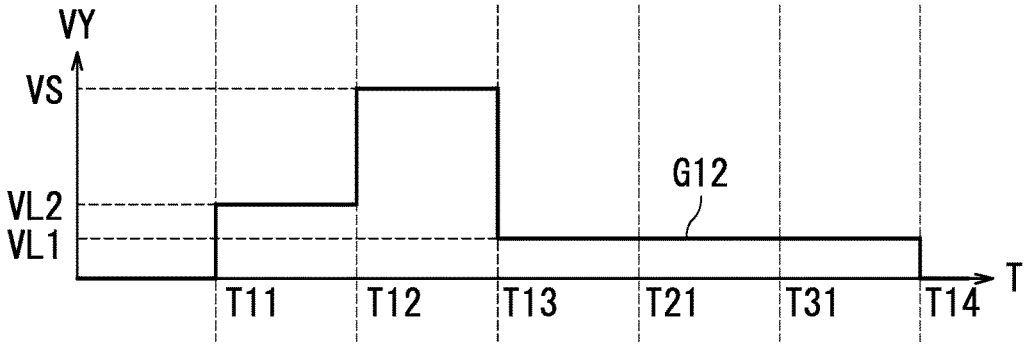
FIGS. 9A to 9D are graphs showing an example of operation of the voltage controller when the voltage value of the second voltage VL2 is greater than the voltage value of the first voltage VL1.
Figure 9B:
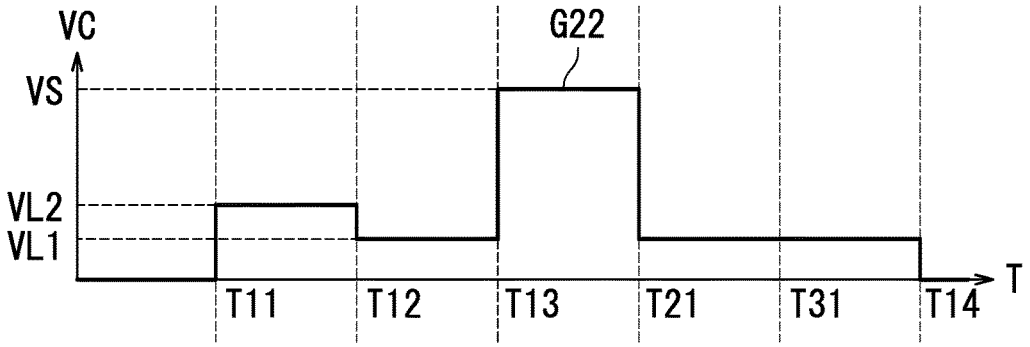
Figure 9C:
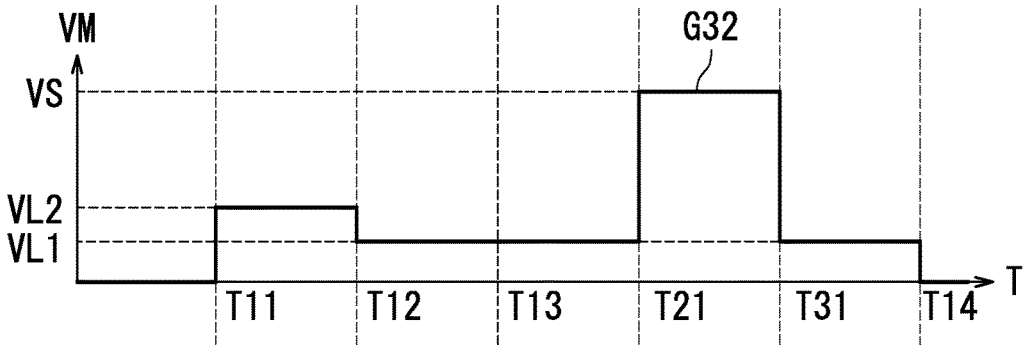
Figure 9D:
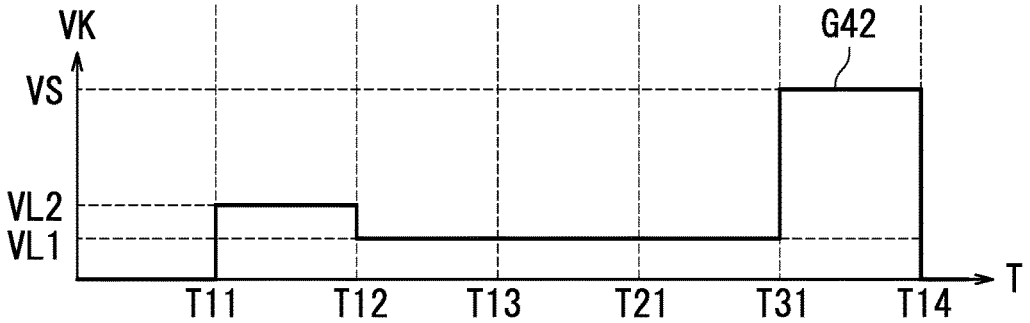

The following describes another example of operation of the voltage controller 911 with reference to FIGS. 9A to 9D. FIGS. 9A to 9D are graphs showing an example of operation of the voltage controller 911 when the voltage value of the second voltage VL2 is greater than the voltage value of the first voltage VL1. FIG. 9A is a graph G12 showing variation of the voltage VY applied to the primary transfer roller 51*y* for the Y (yellow) color. FIG. 9B is a graph G22 showing variation of the voltage VC applied to the primary transfer roller 51*c* for the C (cyan) color. FIG. 9C is a graph G32 showing variation of the voltage VM applied to the primary transfer roller 51*m* for the M (magenta) color. FIG. 9D is a graph G42 showing variation of the voltage VK applied to the primary transfer roller 51*k* for the K (black) color. In each of the graphs, the horizontal axis represents time T and the vertical axis represents the voltage VY, VC, VM, or VK. Further, the direction of the arrow on the vertical axis in each of the graphs indicates that the voltages VY, VC, VM, and VK are negative. In explanation of FIGS. 9A to 9D, the first voltage VL1 is for example 50 V and the second voltage VL2 is for example 70 V.

First, variation of the voltage VY will be described with reference to FIG. 9A. At time point T11, the voltage controller 911 causes the second voltage VL2 to be applied to the primary transfer roller 51*y*. Then at time point T12, the voltage controller 911 changes the voltage VY applied to the primary transfer roller 51*y* from the second voltage VL2 to the detection voltage VS. Next at time point T13, the voltage controller 911 changes the voltage VY applied to the primary transfer roller 51*y* from the detection voltage VS to the first voltage VL1. Further at time point T14, the voltage controller 911 changes the voltage VY applied to the primary transfer roller 51*y* from the first voltage VL1 to zero.

Next, variation of the voltage VC will be described with reference to FIG. 9B. At time point T11, the voltage controller 911 causes the second voltage VL2 to be applied to the primary transfer roller 51*c*. Then, at time point T12, the voltage controller 911 changes the voltage VC applied to the primary transfer roller 51*c* from the second voltage VL2 to the first voltage VL1. Then at time point T13, the voltage controller 911 changes the voltage VC applied to the primary transfer roller 51*c* from the first voltage VL1 to the detection voltage VS. Next at time point T21, the voltage controller 911 changes the voltage VC applied to the primary transfer roller 51*c* from the detection voltage VS to the first voltage VL1. Further at time point T14, the voltage controller 911 changes the voltage VC applied to the primary transfer roller 51*c* from the first voltage VL1 to zero.

Next, variation of the voltage VM will be described with reference to FIG. 9C. At time point T11, the voltage controller 911 causes the second voltage VL2 to be applied to the primary transfer roller 51*m*. Then at time point T12, the voltage controller 911 changes the voltage VM applied to the primary transfer roller 51*m* from the second voltage VL2 to the first voltage VL1. Then at time point T21, the voltage controller 911 changes the voltage VM applied to the primary transfer roller 51*m* from the first voltage VL1 to the detection voltage VS. Next at time point T31, the voltage controller 911 changes the voltage VM applied to the primary transfer roller 51*m* from the detection voltage VS to the first voltage VL1. Further at time point T14, the voltage controller 911 changes the voltage VM applied to the primary transfer roller 51*m* from the first voltage VL1 to zero.

Next, variation of the voltage VK will be described with reference to FIG. 9D. At time point T11, the voltage controller 911 causes the second voltage VL2 to be applied to the primary transfer roller 51*k*. Then at time point T12, the voltage controller 911 changes the voltage VK applied to the primary transfer roller 51*k* from the second voltage VL2 to the first voltage VL1. Then at time point T31, the voltage controller 911 changes the voltage VK applied to the primary transfer roller 51*k* from the first voltage VL1 to the detection voltage VS. Next at time point T14, the voltage controller 911 changes the voltage VK applied to the primary transfer roller 51*k* from the detection voltage VS to zero.

As described above with reference to FIGS. 9A to 9D, during the period between time points T11 and T12, the voltage controller 911 causes the second voltage VL2 to be applied to all the four primary transfer rollers 51*y*, 51*c*, 51*m*, and 51*k*. A second total current value JSL that the current acquiring section 912 acquires during the above period is used by the adjuster 914 to adjust the resistance values R.

During the period between time points T12 and T13, the voltage controller 911 causes the detection voltage VS to be applied to the primary transfer roller 51*y* and the first voltage VL1 to be applied to the other three primary transfer rollers 51*c*, 51*m*, and 51*k*. A first total current value JSy that the current acquiring section 912 acquires during the above period is used by the resistance calculator 913 to determine the resistance value Ry of the primary transfer roller 51*y*.

During the period between time points T13 and T21, the voltage controller 911 causes the detection voltage VS to be applied to the primary transfer roller 51*c* and the first voltage VL1 to be applied to the other three primary transfer rollers 51*y*, 51*m*, and 51*k*. A first total current value JSc that the current acquiring section 912 acquires during the above period is used by the resistance calculator 913 to determine the resistance value Rc of the primary transfer roller 51*c*.

During the period between time points T21 and T31, the voltage controller 911 causes the detection voltage VS to be applied to the primary transfer roller 51*m* and the first voltage VL1 to be applied to the other three primary transfer rollers 51*y*, 51*c*, and 51*k*. A first total current value JSm that the current acquiring section 912 acquires during the above period is used by the resistance calculator 913 to determine the resistance value Rm of the primary transfer roller 51*m*.

During the period between time points T31 and T14, the voltage controller 911 causes the detection voltage VS to be applied to the primary transfer roller 51*k* and the first voltage VL1 to be applied to the other three primary transfer rollers 51*y*, 51*c*, and 51*m*. A first total current value JSk that the current acquiring section 912 acquires during the above period is used by the resistance calculator 913 to determine the resistance value Rk of the primary transfer roller 51*k*.

As described above with reference to FIGS. 3 to 9D, the voltage applicators 61 respectively apply voltages to a specified number of (for example, four) primary transfer rollers 51 (51*y*, 51*c*, 51*m*, and 51*k*). Further, the current detector 62 detects the first total current values JS (JSy, JSc, JSm, and JSk), each of which is a sum of values of currents flowing through the respective four primary transfer rollers 51.

Thus, the resistance values R (Ry, Rc, Rm, and Rk) of the four primary transfer rollers 51 can be determined only with one current detector 62. More specifically, for example, the voltage applicators 61 apply the detection voltage VS to the primary transfer roller 51*y*, which is one of the four primary transfer rollers 51, and apply no voltage to the other primary transfer rollers 51*c*, 51*m*, and 51*k* to detect a first total current value JS. The resistance value Ry of the primary transfer roller 51*y* to which the detection voltage VS has been applied can be determined by dividing the voltage value of the detection voltage VS by the first total current value JS. The resistance values R of the four primary transfer rollers 51 can be determined through the voltage applicators 61 applying the detection voltage VS to the four primary transfer rollers 51 in order. Thus, the number of current detectors 62 for detecting the values of the currents flowing through the primary transfer rollers 51 can be reduced. As a result, the manufacturing cost of the image forming apparatus 1 can be reduced.

Furthermore, when the voltage controller 911 causes the detection voltage VS to be applied to the primary transfer roller 51*y*, which is one of the four primary transfer rollers 51, a voltage having the same polarity as the detection voltage VS is applied to the other primary transfer rollers 51*c*, 51*m*, and 51*k*. In this case, the detection voltage VS is a voltage that is applied for detecting the resistance value Ry of the primary transfer roller 51*y*. The value of the detection voltage VS is a predetermined voltage value (for example, 1000 V). By applying the voltage having the same polarity as the detection voltage VS to the other primary transfer rollers 51*c*, 51*m*, and 51*k*, it is possible to reduce leakage of current from the one primary transfer roller 51*y* to the other primary transfer rollers 51*c*, 51*m*, and 51*k*. Thus, the resistance value Ry of the primary transfer roller 51*y* can be detected accurately. Likewise, the resistance values Rc, Rm, and Rk can be detected accurately. Through the above, transfer voltages each having an appropriate magnitude can be applied to the four primary transfer rollers 51.

Furthermore, when the voltage controller 911 causes the detection voltage VS to be applied to the primary transfer roller 51*y*, which is one of the four primary transfer rollers 51, the first voltage VL1 having a voltage value of no greater than one-tenth of the voltage value of the detection voltage VS is applied to the other primary transfer rollers 51*c*, 51*m*, and 51*k*. Through application of the first voltage VL1, currents flowing into the other primary transfer rollers 51*c*, 51*m*, and 51*k* can be reduced. Furthermore, the first voltage VL1 having a voltage value of at least one-200th of the voltage value of the detection voltage VS is applied to the other primary transfer rollers 51*c*, 51*m*, and 51*k*. Therefore, leakage of current from the one primary transfer roller 51*y* to the other primary transfer rollers 51*c*, 51*m*, and 51*k* can be prevented. As a result, the resistance value Ry of the primary transfer roller 51*y* can be detected more accurately. Likewise, the resistance values Rc, Rm, and Rk can be detected more accurately. Consequently, transfer voltages each having a more appropriate magnitude can be applied to the four primary transfer rollers 51.

Furthermore, the voltage controller 911 causes the second voltage VL2 having the same polarity as the detection voltage VS to be applied to the four primary transfer rollers 51 and the current detector 62 detects the second total current value JSL. Then, the adjuster 914 adjusts the resistance values R based on the second total current value JSL. Meanwhile, when the detection voltage VS is applied to the one primary transfer roller 51*y* and the first voltage VL1 having the same polarity as the detection voltage VS is applied to the other primary transfer rollers 51*c*, 51*m*, and 51*k*, currents flow through the other primary transfer rollers 51*c*, 51*m*, and 51*k*. Therefore, the adjuster 914 adjusts the resistance value Ry of the primary transfer roller 51*y* based on the second total current value JSL. Through the above, it is possible to adjust the resistance value Ry by compensating for influence of the currents flowing through the primary transfer rollers 51*c*, 51*m*, and 51*k* to which the detection voltage VS has not been applied. Thus, the resistance values R of the four primary transfer rollers 51 can be detected more accurately. Consequently, transfer voltages each having a more appropriate magnitude can be applied to the four primary transfer rollers 51.

The voltage value of the second voltage VL2 is most preferably the same as the voltage value of the first voltage VL1 (the configuration illustrated in FIGS. 5A to 5D). In this case, the adjuster 914 can accurately adjust the resistance value Ry by compensating for the influence of the currents flowing through the primary transfer rollers 51*c*, 51*m*, and 51*k* to which the detection voltage VS has not been applied. Thus, the resistance values R of the four primary transfer rollers 51 can be detected more accurately. Consequently, transfer voltages each having a more appropriate magnitude can be applied to the four primary transfer rollers 51.

Alternatively, the voltage value of the second voltage VL2 may be greater than the voltage value of the first voltage VL1 (the configuration illustrated in FIGS. 9A to 9D). In other words, the voltage value of the first voltage VL1 may be smaller than the voltage value of the second voltage VL2. In the above configuration, the currents flowing through the primary transfer rollers 51*c*, 51*m*, and 51*k* to which the detection voltage VS has not been applied can be reduced. Therefore, the adjuster 914 can accurately adjust the resistance value Ry by compensating for the influence of the currents flowing through the primary transfer rollers 51*c*, 51*m*, and 51*k* to which the detection voltage VS has not been applied. Thus, the resistance values R of the four primary transfer rollers 51 can be detected accurately. Furthermore, transfer voltages each having a more appropriate magnitude can be applied to the four primary transfer rollers 51.

Furthermore, after application of the second voltage VL2 to the four primary transfer rollers 51, the voltage controller 911 causes the detection voltage VS to be applied to the primary transfer roller 51*y*, which is one of the four primary transfer rollers 51, and the first voltage VL1 to be applied to the other primary transfer rollers 51*c*, 51*m*, and 51*k*. Accordingly, the voltage applied to the primary transfer roller 51*y* changes from the first voltage VL1 to the detection voltage VS. Therefore, a time necessary to change the voltage applied to the primary transfer roller 51*y* to the detection voltage VS can be reduced. Consequently, a time necessary to detect the resistance values R of the four primary transfer rollers 51 can be reduced.

Further, the resistance calculator 913 determines the resistance value Ry of the primary transfer roller 51*y* based on the plurality of (for example, 12) voltage values VT1 to VT12 of the detection voltage VS that is applied to the one primary transfer roller 51*y* and the first total current values JS. Likewise, the resistance values Rc, Rm, and Rk of the other primary transfer rollers 51*c*, 51*m*, and 51*k* are determined. Thus, the resistance values R of the four primary transfer rollers 51 can be determined accurately. More specifically, the resistance value R of each of the four primary transfer rollers 51 can be determined more accurately by for example determining a straight line representing a relationship between the voltage values of the detection voltage VS and the first total current values JS, and determining the inverse of the slope of the straight line. Through the above, transfer voltages each having an appropriate magnitude can be applied to the four primary transfer rollers 51.

Through the above, an embodiment of the present disclosure has been described with reference to the drawings. However, the present disclosure is not limited to the above embodiment and may be implemented in various different forms that do not deviate from the essence of the present disclosure (for example, as described below in sections (1) to (5)). The drawings schematically illustrate elements of configuration in order to facilitate understanding and properties of the elements of configuration illustrated in the drawings, such as thickness, length, and number thereof, may differ from actual properties thereof in order to facilitate preparation of the drawings. Furthermore, properties of elements of configuration described in the above embodiment, such as shapes and dimensions, are merely examples and are not intended as specific limitations. Various alterations may be made so long as there is no substantial deviation from the configuration of the present disclosure.

(1) The present disclosure is described with reference to FIG. 1 for a configuration in which the image forming apparatus 1 includes four primary transfer rollers 51*c*, 51*m*, 51*y*, 51*k* and four photosensitive drums 42*c*, 42*m*, 42*y*, and 42*k*. However, the present disclosure is not limited to such a configuration. In other words, the "specified number" is not limited to four. It is only required that the image forming apparatus 1 includes a specified number of primary transfer rollers and the specified number of photosensitive drums. The specified number may for example be two, three, five or more.

(2) The present disclosure is described with reference to FIG. 4 for a configuration in which the voltage value of the first voltage VL1 is at least one-200th and no greater than one-tenth of the voltage value of the detection voltage VS. However, the present disclosure is not limited to such a configuration. No particular limitations are placed on the first voltage VL1 so long as the first voltage VL1 has the same polarity as the detection voltage VS.

(3) The present disclosure is described with reference to FIGS. 5A to 5D for a configuration in which the voltage controller 911 causes the detection voltage VS to be applied to the four primary transfer rollers 51*y*, 51*c*, 51*m*, and 51*k* in the noted order. However, the present disclosure is not limited to such a configuration. In other words, the voltage controller 911 may cause the detection voltage VS to be applied to the primary transfer rollers 51 in any order. In a configuration, for example, the detection voltage VS may be applied to the four primary transfer rollers 51*k*, 51*m*, 51*c*, and 51*y* in the noted order.

(4) The present disclosure is described with reference to FIG. 6 for a configuration in which the resistance calculator 913 determines the inverse of the slope of the straight line. However, the present disclosure is not limited to such a configuration. In a configuration, the resistance calculator 913 may obtain a curve that approximates coordinates of the measurement points PT instead of the straight line. In such a configuration, the resistance value R is determined as the inverse of the slope of the curve.

(5) The present disclosure is described with reference to FIGS. 9A to 9D for a configuration in which the voltage value of the second voltage VL2 is greater than the voltage value of the first voltage VL1. However, the present disclosure is not limited to such a configuration. In a configuration, the voltage value of the second voltage VL2 may be no greater than the voltage value of the first voltage VL1.

What is claimed is:

1. An image forming apparatus for forming an image on a recording medium, comprising:

a specified number of photosensitive drums, the specified number being two or more;

a specified number of developing devices, each forms a toner image on a corresponding one of the specified number of photosensitive drums;

a specified number of primary transfer rollers each located opposite to a corresponding one of the specified number of photosensitive drums;

an intermediate transfer belt held between the specified number of photosensitive drums and the specified number of primary transfer rollers;

a specified number of voltage applicators, each applies a voltage to a corresponding one of the specified number of primary transfer rollers;

a single current detector that detects a total current value, the total current value being a sum of values of currents flowing through the specified number of primary transfer rollers; and a voltage controller that controls voltage values of voltages that the specified number of voltage applicators apply to the specified number of primary transfer rollers, wherein the voltage controller causes a detection voltage, having a predetermined voltage value, to be applied to one primary transfer roller of the specified number of primary transfer rollers while simultaneously causing a voltage having the same polarity as the detection voltage to be applied to all other of the primary transfer rollers, wherein the voltage that the voltage controller causes to be applied to the all other of the primary transfer rollers is a first voltage having a voltage value smaller than the detection voltage, the single current detector detects a first total current value that is a sum of values of currents flowing through the specified number of primary transfer rollers, and the detection voltage is a voltage that is applied to determine a resistance value of the one primary transfer roller of the specified number of primary transfer rollers to be used during image formation on the recording medium.

2. The image forming apparatus according to claim 1, wherein the first voltage having a voltage value of at least one-200th and no greater than one-tenth of the voltage value of the detection voltage.

3. The image forming apparatus according to claim 2, further comprising a resistance calculator that determines a resistance value of each of the specified number of primary transfer rollers based on the first total current value.

4. The image forming apparatus according to claim 3, wherein the resistance calculator determines the resistance value of each of the specified number of primary transfer rollers by dividing the voltage value of the detection voltage by the first total current value.

5. The image forming apparatus according to claim 3, further comprising an adjuster that adjusts the resistance value, wherein the voltage controller causes a second voltage having the same polarity as the detection voltage to be applied to all the specified number of primary transfer rollers, the single current detector detects a second total current value that is a sum of values of currents flowing through the specified number of primary transfer rollers, and the adjuster adjusts the resistance value based on the second total current value.

6. The image forming apparatus according to claim 5, wherein a voltage value of the second voltage is substantially the same as the voltage value of the first voltage.

7. The image forming apparatus according to claim 5, wherein a voltage value of the second voltage is greater than the voltage value of the first voltage.

8. The image forming apparatus according to claim 5, wherein the adjuster adjusts the resistance value by dividing the voltage value of the detection voltage by an adjusted current value, and the adjusted current value is obtained by dividing the second total current value by the specified number of primary transfer rollers, and multiplying obtained quotient by a value obtained by subtracting 1 from the specified number of primary transfer rollers, and subtracting obtained product from the first total current value.

9. The image forming apparatus according to claim 5, wherein the voltage controller causes the detection voltage to be applied to the one primary transfer roller and the first voltage to be applied to the all other of the primary transfer rollers, after causing the second voltage to be applied to all the specified number of primary transfer rollers.

10. The image forming apparatus according to claim 2, further comprising a resistance calculator that determines a resistance value of each of the specified number of primary transfer rollers, wherein the voltage controller causes the detection voltage to be varied to have a plurality of different voltage values to be applied to the one primary transfer roller while causing the first voltage to be applied to the all other of the primary transfer rollers, the single current detector detects a plurality of the first total current values respectively corresponding to the plurality of different voltage values, and the resistance calculator determines the resistance value of each of the specified number of primary transfer rollers based on the plurality of different voltage values and the plurality of the first total current values.

* * * * *